United States Patent [19]

Aman, Jr.

[11] 4,193,746

[45] Mar. 18, 1980

[54] REVERSIBLE GEROTOR PUMP

[75] Inventor: Robert C. Aman, Jr., Minneapolis, Minn.

[73] Assignee: Westinghouse Electric Corp., Pittsburgh, Pa.

[21] Appl. No.: 878,552

[22] Filed: Feb. 16, 1978

[51] Int. Cl.[2] ..... F04C 1/06; F04C 15/02

[52] U.S. Cl. ..... 418/32; 418/171

[58] Field of Search ..... 418/32, 166, 170, 171; 417/315

[56] References Cited

FOREIGN PATENT DOCUMENTS

| | | | |
|---|---|---|---|
| 130602 | 7/1947 | Australia | 418/32 |
| 1553281 | 9/1969 | Fed. Rep. of Germany | 418/32 |
| 2055883 | 5/1972 | Fed. Rep. of Germany | 418/32 |

*Primary Examiner*—John J. Vrablik

*Attorney, Agent, or Firm*—F. A. Winans

[57] ABSTRACT

A reversible gerotor pump is shown which delivers a lubricant in a predetermined manner regardless of direction of rotation. The reversibility is provided by an eccentric collar having a cylindrical opening encircling the pump rotor and which is rotatable through a 180° arc by frictional engagement with the rotor. To ensure this frictional engagement is greater than the frictional engagement between the collar and an adjacent stationary face plate which opposes rotation of the eccentric collar, the surface of the collar in facing engagement with the plate defines slight protrusions projecting therefrom. The protrusions abut the plate for a limited surface engagement therebetween and therefore provide limited frictional engagement. In this manner the friction between the collar and the stationary plate is minimized and the eccentric collar is relatively free to be rotated to either of two extreme positions within the 180° arc depending upon the direction of the rotation of the rotor.

3 Claims, 4 Drawing Figures

REVERSIBLE GEROTOR PUMP

BACKGROUND OF THE INVENTION

1. Field of the Invention

This invention relates to a gear pump (commonly called a gerotor pump) and more particularly to a reversible gerotor pump having a movable eccentric member rotatable in response to the direction of rotation of the rotor.

2. Description of the Prior Art

Gear pumps such as the reversible pump described in U.S. Pat. No. 3,273,501 are commonly used to deliver lubricant to compressors, such as refrigerant compressors in a refrigeration system. As explained in U.S. Pat. No. 3,574,489, orbital gear-sets providing rolling contact between an outer internally-toothed gear which has one more tooth than an inner externally-toothed gear and which mesh with their axes eccentric to one another are commercially available under the generic designation "gerotors". Pumps employing such arrangement for positive displacement of fluid caused by the rolling contact between the meshing teeth are referred to as gerotor pumps.

In such gerotor pumps, inlets and outlets are generally defined in face plates on opposing planar sides of the mating gears, and are, for the most part, diametrically opposed (i.e. 180° out-of-phase). Thus, with the gears rotating in one direction, the pump inlet is adjacent the area where the gears are separating and the outlet is adjacent the area where the gears are meshing. By reversing the direction of the gears the outlet becomes the inlet and the inlet the outlet.

However, in instances where reversibility of the pump is desired but yet is is also necessary that the inlet and outlet do not reverse, the rotor (i.e. the outer, internally-toothed gear) has been disposed in an opening of a rotatable eccentric collar member which can be rotated through a 180° arc to change the orientation of the eccentric axes between the rotor and the internal gear such that, in either direction of rotation, the pump has a common inlet and outlet.

The movement or rotation of the eccentric collar member through the 180° arc has been dependent upon a friction between the drive shaft and a rotatable face plate positively engaging the eccentric collar such as shown in U.S. Pat. No. 3,165,066 or between the outer circular surface of the rotor and the internal cylindrical surface of the eccentric member as disclosed in previously mentioned U.S. Pat. No. 3,273,501. An indexing pin or tab is provided that limits the movement of the eccentric member to 180° whereby continued rotation of the rotor causes continuous friction to maintain the member in the extreme position. However, in either instance, this continuous friction also causes wear between the two parts such that in the first instance the frictionally engaging parts will wear out quite readily whereas in the second instance, over a period of time, the friction between the eccentric member and the stationary face plate covering the rotor will be greater than the friction between the eccentric member and the rotor, in which instance the eccentric member is not always responsive to the rotation of the rotor to change its orientation and the pump does not circulate the lubrication as intended, causing damage to the machinery being lubricated.

SUMMARY OF THE PRESENT INVENTION

The present invention is an improvement to the gerotor pumps above described and provides limited frictional engagement between the rotatable eccentric collar member and the stationary face plate such that the frictional engagement between the eccentric member and the rotor exceeds any frictional resistance to the rotation of the eccentric member by the face plate, thereby causing the eccentric member to rotate with the rotor, at least to the extent permitted by the indexing means to assure pumping discharge through a common outlet.

DESCRIPTION OF THE INVENTION

Figure 1:
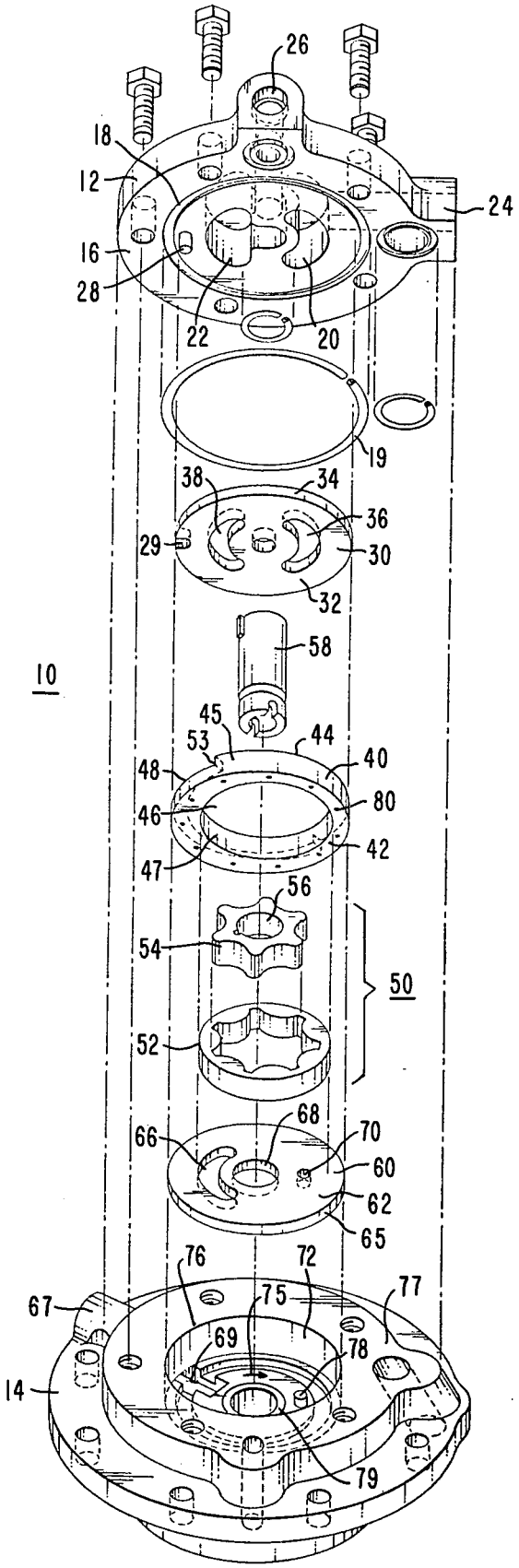
FIG. 1 is an exploded isometric view of a reversible gerotor pump assembly.
Figure 2:
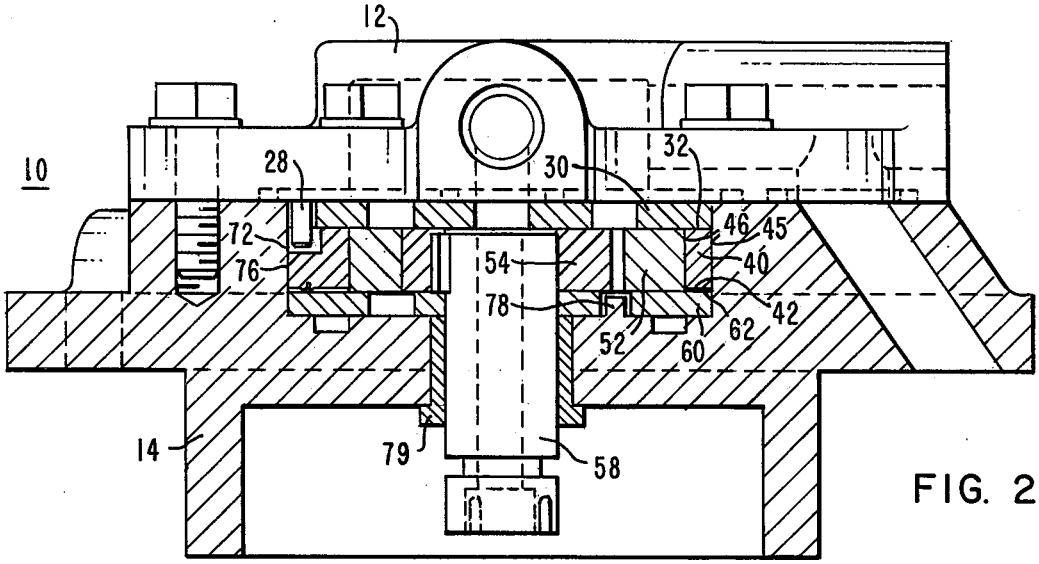
FIG. 2 is an elevational cross-sectional view of the gerotor pump.

Referring to FIGS. 1 and 2, the reversible gerotor pump 10 is shown in disassembled and assembled form respectively. As therein seen the pump comprises an upper housing member 12 and an opposed lower housing member 14. The upper housing member 12 has a generally planar interior face 16 having a circular groove 18 machined therein for locating an "O" ring 19. A pair of generally arcuate diametrically opposed cavities 20, 22 are formed within the upper member. Cavity 20 is in flow communication with a pump inlet opening 24 on the periphery of the upper member and cavity 22 is in flow communication with the pump outlet opening 26 also on the periphery of the upper housing member 12. An indexing pin 28 projects downwardly from the surface 16 toward the lower housing member 14.

An upper face plate 30 having opposed planar surfaces (lower surface 32 being shown in FIG. 1) and a circular periphery 34 is disposed in facing engagement with the surface 16 of the housing 12 within the confines of the "O" ring. Plate 30 also contains a pair of diametrically opposed arcuate openings 36, 38 which are in alignment with the cavities 20, 22 in member 12 as indexed by pin 28 extending through an indexing notch 29 in the periphery of the plate 30.

An eccentric collar member 40 also having opposed planar sides 42, 44 and a circular periphery 45 concentric with and generally equal to the periphery 34 of the plate 30 is disposed so that upper face 44 thereof is in facing engagement with surface 32 of the plate 30. The collar member 40 defines a circular opening 46 having an internal peripheral surface 47 and formed on an axis separate from and eccentric to the axis of the circular periphery 45 so that the opening 46 is eccentric to the outer periphery 45. Surface 44 has an upper facing notch 48 extending over a 180° arcuate extent, and when the eccentric collar member 40 is in facing engagement with the plate 30, the pin 28 extends into the notch 48 and abuts the terminal ends or shoulders 51, 53 thereof to limit the permitted rotation of the eccentric collar to 180°.

A gerotor gear-set 50 comprising an internally-toothed rotor 52 and an externally-toothed gear 54 is disposed within the opening 46 of the collar member 40. The outer circular periphery of the rotor 52 is sized to fit, with close tolerances, within the opening 46 yet it is relatively freely rotatable therein. As is known, the axes of the respective teeth of the gear-set are off-set to provide eccentricity so the teeth mesh only over a limited arcuate extent. The internal gear 54 has a central keyed opening 56 that is concentric with the outer periphery of the collar member 40 for receipt therein of a drive shaft 58 which, although not shown, is driven by any drive means such as the crankshaft of a refrigerant compressor or the crankshaft of an internal combustion engine.

A lower or outer face plate 60 having opposed substantially planar surfaces 62, 64 and a circular periphery 65 concentric with and generally equal in diameter to the outer periphery 45 of the collar member 40, is disposed with surface 62 in facing engagement with lower surface 42 of the collar member 40 and also in facing engagement with the lower surface of the rotor 52 and gear 54. Plate 60 defines an arcuate opening 66 in general alignment with opening 38 in the top plate 30 to define another discharge orifice which is in alignment with a cavity 69 in the lower pump housing (described later) which in turn may have a threaded opening 67 thereto for mounting a pressure gauge for measuring or monitoring the pump pressure. The plate 60 also contains a central circular opening 68 for receipt therethrough of the drive shaft 58 and a small opening 70 for receipt of an indexing pin 78 in the lower housing to align the opening 66 in the plate with the cavity 69 in the lower member.

The pump 10 is completed by the lower housing member 14 defining on one face a cylindrical or cup-shaped enclosure 72 have a generally planar bottom surface 75 and a circular internal sidewall 76 concentric with and just slightly larger in diameter than the outer circular surface 45 of the eccentric collar member 40. The upper surface 77 of the enclosure is substantially planar for abutting sealing engagement with the surface 16 of the upper housing. A pin 78 projects upwardly from the bottom to extend into the opening 70 of the bottom plate 60 and index it in the proper position. The bottom wall supports a bearing 79 for receipt therethrough of the keyed drive shaft 58.

Thus, as assembled, the pump 10 as shown in FIG. 2, has upper and lower face plates 30 and 60, respectively, engaging opposite sides of the eccentric collar member 40 with the gear 54 and rotor 52 disposed within the opening 46 of the member. The above parts, in this relationship, are disposed within the enclosure 72 of the lower housing member 14 with the drive shaft 58 extending through the lower housing 14, the lower plate 60 and into driving engagement with the gear 54. The height of the enclosure 72 is just slightly larger than the height of the stacked components and the thickness of the collar 40 is just slightly less than the height or thickness of the gear set 50. Also, the enclosure 72 is slightly larger in diameter than the eccentric collar member 40. Thus, the collar member 40 is relatively free to rotate within the enclosure between the plates 30, 60 and the gear-set is also relatively free to rotate therebetween while the plates are held stationary by the projecting pins 28 and 78.

Figure 3:
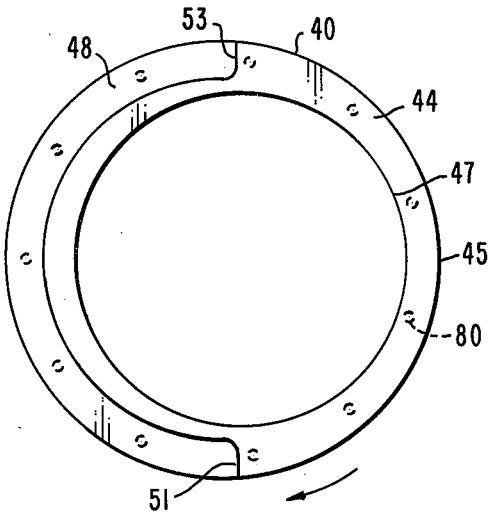
FIG. 3 is a top plan view of the eccentric collar member.

Referring to FIG. 3, the upper surface 44 of the eccentric collar member 40 is shown to more clearly show the 180° arcuate notch 48 terminating in the shoulders 53 and 51. Thus, with the drive shaft 58 rotating in the direction of the arrow frictional engagement between the outer circular surface of the rotor 52 and the inner surface 47 of the eccentric member 40 would cause the eccentric member 40 to rotate until shoulder 51 abutted pin 28. In such position the gear set would be oriented to discharge the pump fluid through the proper cavity and outlets. Reversing the shaft rotation would cause the eccentric member 40 to be frictionally dragged through a 180° arc until the pin 28 abutted shoulder 53. This 180° change maintains the gear and rotor meshing function, with respect to the outlets, constant so that the pump continues to discharge through the same outlets as before.

However, as previously stated, if reversing the direction of drive does not in fact change the position of the eccentric member 40, the pump will not discharge through the outlets, thereby preventing proper lubrication, and eventually damaging such machine.

Reversing the position of the eccentric collar member 40 is caused by the frictional drag between the circular surface of the positively driven rotor 52 and the mating circular surface 47 of the eccentric opening 46. Movement of the eccentric member 40 however, is opposed by friction between facing surfaces 32, 62, of each adjacent stationary plate and the adjacent eccentric member 40. Also, the surface 45 of the periphery of the collar member 40 and the surface 76 of the stationary cavity 72 in the pump housing may tend to impede movement of the collar 40. However, to minimize such friction, the outer diameter of the collar member 40 is considerably less (i.e. on the order of 0.06 inches) than the inner diameter of the cavity 72. It will also be noted that during operation all surfaces of the plates, 30, 60, rotor 52, and pump housing 76 will become coated by the lubricant being pumped so that there will thereafter be a layer of lubricant on all surfaces. However, after a period of rest the film may dissipate and the surfaces become virtually in contact and at their maximum frictional engagement. As all adjacent facing surface are machined for relatively close tolerances, the flat facing surfaces and the circular facing surfaces provide generally coextensive frictional engagement therebetween. However, in that the upper surface 44 of the eccentric collar member 40 is notched, there is a much reduced area for frictional engagement between the upper surface 44 of the collar and the lower surface 32 of the top plate 30. Thus, the major frictional engagement that contributes to non-rotation of the eccentric collar member 40 is between the upper surface 62 of the lower plate 60 and the lower surface 42 of the collar member 40. To limit the contact between the lower surface 42 of the eccentric collar member 40 and the upper surface 62 of the lower plate, the lower surface 42 has been punched to provide a plurality of protuberances 80 (shown in FIG. 3 but on the surface opposite the upper surface 44) to elevate the otherwise flat surface 42 from the flat surface 62 of the plate 60 and thereby limiting the frictional engagement therebetween.

Figure 4:
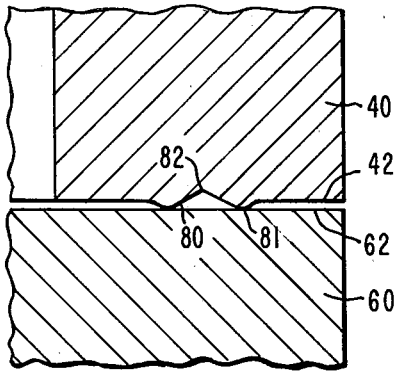
FIG. 4 is an enlarged cross-sectional view of a portion of the collar member showing proturbances on the lower surface for limited contact with the adjacent facing end plate of the pump.

The proturberances 80 in the lower face 42 of the collar 40, as depicted in FIG. 4 were formed by merely striking surface 42 with a center punch causing an indentation 82 with displacement of the surrounding metal to produce the outwardly extending projections 81. Referring to FIGS. 1 and 3 it is seen that a plurality of angularly separated protuberances 80 are provided to ensure that the facing surfaces 42 and 62 remain substantially parallel to each other to prevent cocking of the collar member within the pump.

Depending upon the striking force of the centering punch, the outward extent of the protuberances 80 vary from approximately 0.0005 to 0.001 inch. However, since the eccentric collar member 40 is generally on the order of 0.005 inches less in height than the gear set 50, this added overall height to the eccentric collar member 40 does not cause an interference fit of the collar member between the opposed upper and lower plates 30, 60 which engage the upper and lower surfaces of the gear-set 50.

With such protuberances 80 elevating, the lower surface 42 of the eccentric collar member 40 from the upper surface 62 of the lower plate 60 and thereby limiting frictional engagement therebetween, the frictional drag between the eccentric collar member 40 and the rotor 52 of the gear-set should exceed any friction that tends to maintain the collar member stationary and thus ensures the collar will rotate to the proper orientation in response to the gear-set and particularly the rotor 52 being driven in either of the two directions.

I claim:

1. A reversible pump having a housing defining a generally cylindrical cavity, an internally-toothed rotor having a circular periphery and an eccentric meshing engagement with an externally-toothed gear, drive means extending into said housing for driving said gear and rotor, a collar member having a substantially cylindrical outer peripheral surface sized to be in close proximity to the cylindrical surface of the housing and having a planar lower surface adjacent the planar surface of a stationary member in the said cavity and defining a cylindrical opening on an axis eccentric from the outer peripheral surface, said opening sized to receive said rotor in a generally close fit and with said collar member rotatable within said housing through frictional engagement with said rotor, means for limiting the rotation of said collar member to a 180° arc for positioning the rotor axis within said opening relative to the gear axis to maintain delivery of a pumped fluid to a discharge opening in said pump and a plurality of discrete projections struck up from the normal planar surface of the member for limiting the surface area of contact between the member and the support surface and in turn thereby limiting the frictional engagement between said collar member and the planar stationary adjacent facing surface so as to be less than the frictional engagement between said collar and said rotor.

2. A reversible pump having a housing defining a generally cylindrical cavity, in flow communication with pump inlet and outlet openings, an eccentric gear-set disposed within said cavity and means for driving said gear-set for pumping fluid through said outlet opening, an eccentric collar member encircling said gear-set and reversibly movable between two positions for positioning said gear-set to pump through said outlet opening irrespective of the direction of rotation of said drive means, said member having a substantially cylindrical outer peripheral face sized to closely fit within said cylindrical cavity and a generally planar lower surface supported on the bottom planar surface of said cavity, said member having a cylindrical opening parallel and eccentric to the outer surface and sized to receive said gear-set in generally close proximity whereby rotation of said gear-set causes rotation of said member through frictional engagement therebetween, and an annular array of discrete protrusions struck-out from the generally planar face of the eccentric member to thereby limit the area of surface contact between said collar member and the adjacent stationary bottom surface of said cavity so that the frictional engagement therebetween is less than frictional engagement between facing surfaces of the gear-set and said member so that said member is caused to rotate upon reversal of said gear-set.

3. In a reversible gerotor pump having a housing defining a generally cylindrical cavity in flow communication with pump inlet and outlet openings and seating therein a reversible eccentric gear-set on a substantially planar stationary support surface and having means for driving said gear-set, and an eccentric collar member disposed in said cavity on said support surface and encircling said gear-set and reversibly movable between two separate positions in response to the reversed rotation of said gear-set for positioning said gear-set to pump through said outlet opening irrespective of the direction of rotation of said drive means, an annular array of discrete projections struck out from the normal planar surface of said member and generally equiangularly spaced about said surface to maintain said surface substantially parallel to and supported on said support surface for thereby limiting the frictional engagement between said collar member and said stationary support surface.

* * * * *